US005255853A

United States Patent [19]

Munoz

[11] Patent Number: 5,255,853

[45] Date of Patent: Oct. 26, 1993

[54] ADJUSTABLE FLUID JET CLEANER

[75] Inventor: Jose P. Munoz, West Bloomfield, Mich.

[73] Assignee: Ingersoll-Rand Company, Woodcliff Lake, N.J.

[21] Appl. No.: 912,400

[22] Filed: Jul. 13, 1992

Related U.S. Application Data

[63] Continuation-in-part of Ser. No. 679,279, Apr. 2, 1991.

[51] Int. Cl.[5] ..... B24C 5/04

[52] U.S. Cl. ..... 239/433; 239/587.4; 239/590.3; 51/439; 83/177

[58] Field of Search ..... 239/587.4, 550, 243, 239/247, 264, 590.3, 227, 225.1, DIG. 1, 433; 51/410, 436, 439, 317-319, 321; 83/177; 403/409.1

[56] References Cited

U.S. PATENT DOCUMENTS

| | | | |
|---|---|---|---|
| 2,947,556 | 8/1960 | Wenger | 403/409.1 |
| 4,545,157 | 10/1985 | Saurwein | 51/439 |
| 4,596,362 | 6/1986 | Pralle et al. | 239/587.4 |
| 4,793,557 | 12/1988 | Marchese et al. | 239/587.3 |
| 4,802,628 | 2/1989 | Dautel et al. | 239/227 |
| 4,817,874 | 4/1989 | Jarzebowicz | 239/587.4 |
| 4,832,266 | 5/1989 | Marvin | 239/590.3 |
| 4,836,455 | 6/1989 | Munoz | 239/590.3 |
| 5,018,670 | 5/1991 | Chalmers | 51/439 |
| 5,133,618 | 7/1992 | Mentesh | 403/409.1 |
| 5,139,202 | 8/1992 | Munoz et al. | 239/587.4 |

*Primary Examiner*—Andres Kashnikow
*Assistant Examiner*—Lesley D. Morris
*Attorney, Agent, or Firm*—Walter C. Vliet; Glenn B. Foster

[57] ABSTRACT

A fluid jet system includes a nozzle body which has an axis. A nozzle is adjustably mounted within the nozzle body for dispersing fluid along a centerline. A first adjustment device adjusts the orientation of the nozzle relative to the nozzle body. A focusing tube is included. A second adjustment device positions the focusing tube, relative to the nozzle body, into alignment with the nozzle. One embodiment permits continual alignment of the focusing tube relative to the nozzle as the second adjustment device is being adjusted.

8 Claims, 4 Drawing Sheets

ADJUSTABLE FLUID JET CLEANER

BACKGROUND OF THE INVENTION

This is a continuation-in-part of application Ser. No. 07/679,279 filed Apr. 2, 1991 patent pending.

This invention relates generally to fluid jet cleaning systems, and more particularly to a fluid jet which may be adjusted to control the cleaning position and intensity of the device.

In prior fluid jet cleaning systems, the angle at which the fluid jet exits the nozzle body is fixed relative to the body. In these prior art designs, it is often difficult to regulate the cleaning intensity of the system without altering the fluid pressure, orifice size, number of orifices, etc. It is also difficult to precisely locate the fluid jet or jets, as desired relative to the working surface.

The foregoing illustrates limitations known to exist in present fluid jet cleaners. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluid jet system including a nozzle body which has an axis. A nozzle is adjustably mounted within the nozzle body for dispersing fluid along a centerline. A first adjustment device adjusts the orientation of the nozzle relative to the nozzle body. A focusing tube is included. A second adjustment device positions the focusing tube, relative to the nozzle body, into alignment with the nozzle.

The foregoing and other aspects will become apparent from the following detailed description of the invention when considered in conjunction with the accompanying drawing figures.

BRIEF DESCRIPTION OF THE DRAWING FIGURES

Figure 7:
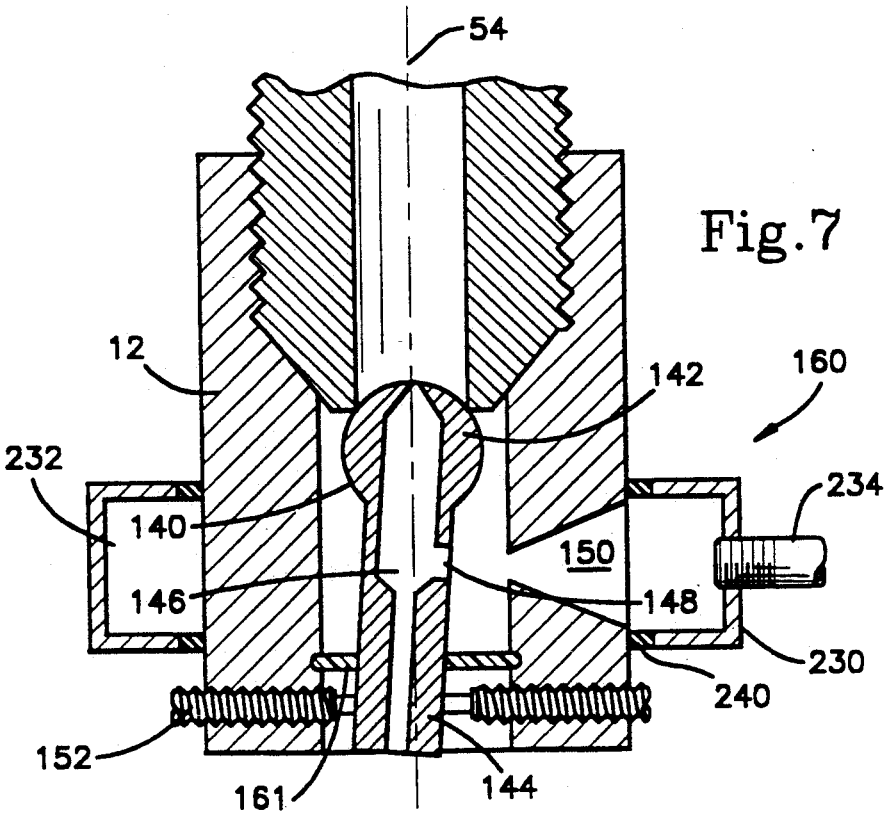
Figure 8:
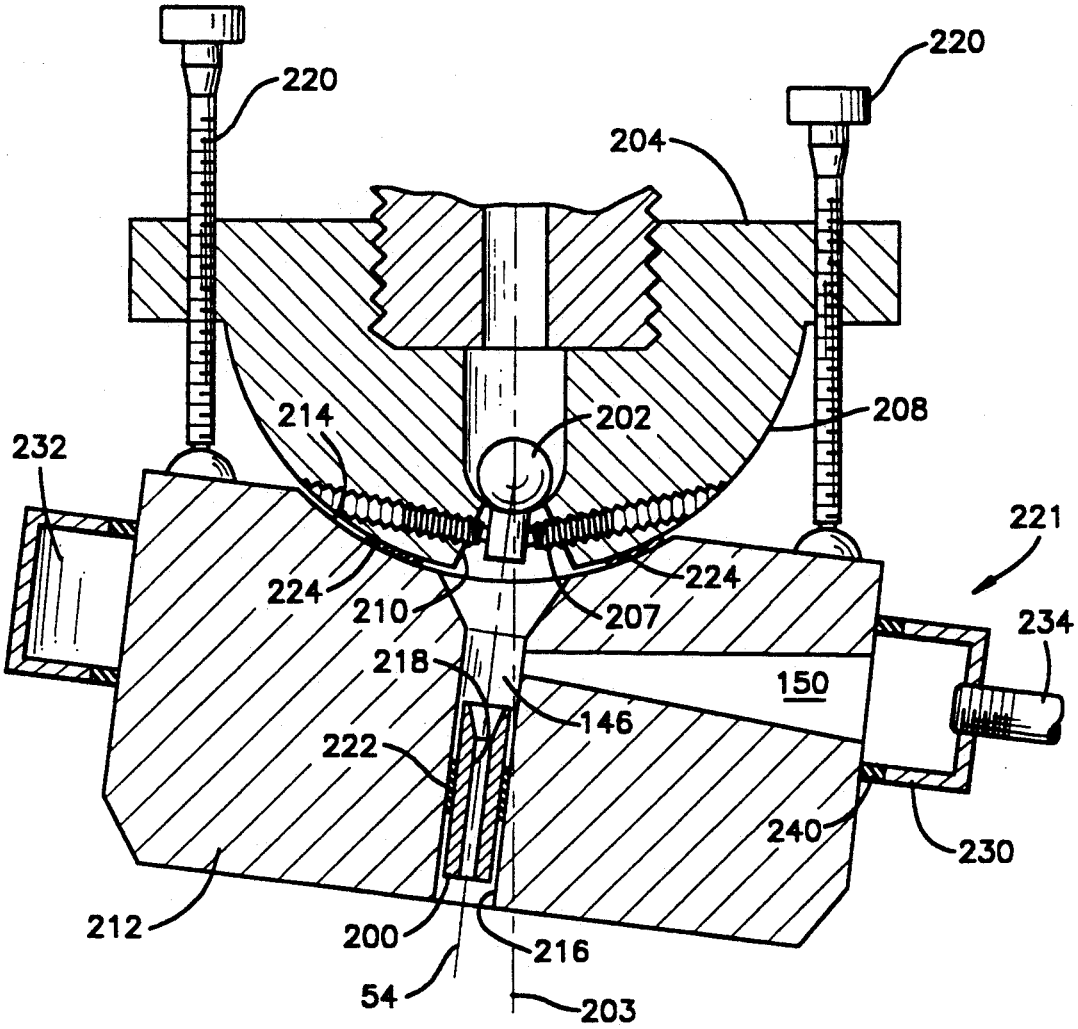

FIG. 7 is a side cross-sectional view of a fluid jet cleaner of another embodiment of the present invention, further including an adjustable portion to adjust a section which introduces abrasives to a fluid stream; and FIG. 8 is a side cross-sectional view of a final embodiment of fluid jet cleaner of the present invention, further including an adjustable portion to adjust a section which introduces abrasives to a fluid stream.

DETAILED DESCRIPTION

Figure 1:
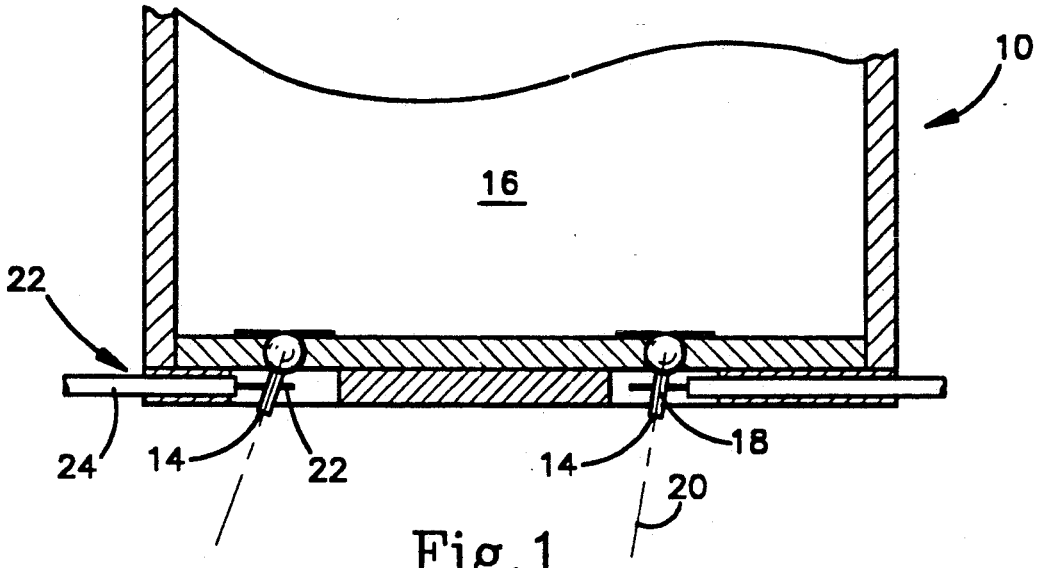
FIG. 1 is a side cross sectional view illustrating an embodiment of fluid jet cleaner of the instant invention.

FIG. 1 illustrates a fluid jet cleaner 10 of the instant invention which includes a nozzle body 12 and a plurality of adjustable nozzles 14. In this specification, the terms "nozzle" and "nozzle means" will be used interchangeably; Also, the terms "fluid jet cleaner" and "fluid jet system" are meant to cover fluid jet millers and fluid jet cutters as well as traditional fluid jet cleaners, which are all similar in structure but utilize different abrasives, nozzle configurations and/or material removal times. This fluid jet cleaner 10 illustrated is of the jet fan nozzle type, even though this invention applies to nozzle configurations of other types. The nozzle body 12 forms a reservoir 16 which contains fluid under pressure. The fluid contained within the reservoir is in fluid communication with nozzle apertures 18 formed within the nozzles. Fluid escaping from the reservoir 16 through the nozzle apertures 18 will be projected, for all practical purposes, along a centerline 20.

The nozzle body 12 of the fluid jet cleaner 10, in this embodiment, may or may not be stationary. Adjustment means 22 is included to adjust the centerline direction of each nozzle relative to the nozzle body 12. The adjustment means typically comprises a plurality of radially disposed longitudinally extensible rod members 24, selectively extendable to align the centerline 20 of the each individual nozzle 14. The function of the adjustment means is described in greater detail below.

Figure 2:
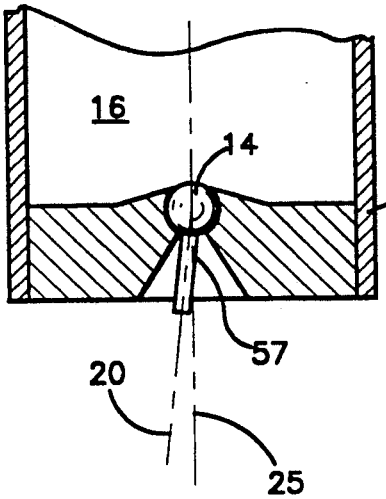
FIG. 2 is a side cross sectional view illustrating an alternate embodiment of fluid jet cleaner of the instant invention.

While the embodiment of FIG. 1 illustrates a nozzle body 12 having a plurality of nozzles 14, it is within the intended scope of the present invention to provide a nozzle body 12 having only one nozzle as illustrated in FIG. 2. In this embodiment, the angular offset of the centerline 20 relative to a reference line 25 of the nozzle body 12 is illustrated.

Figure 3:
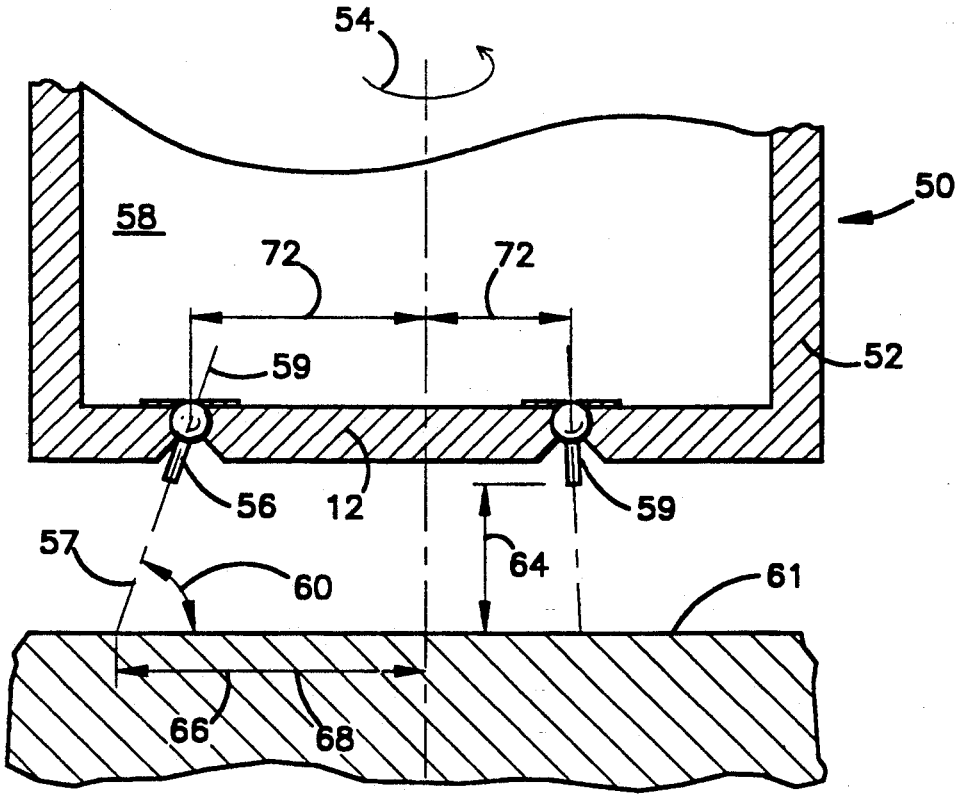
FIG. 3 is a side cross sectional view illustrating yet another alternate embodiment of fluid jet cleaner of the instant invention.
Figure 4:
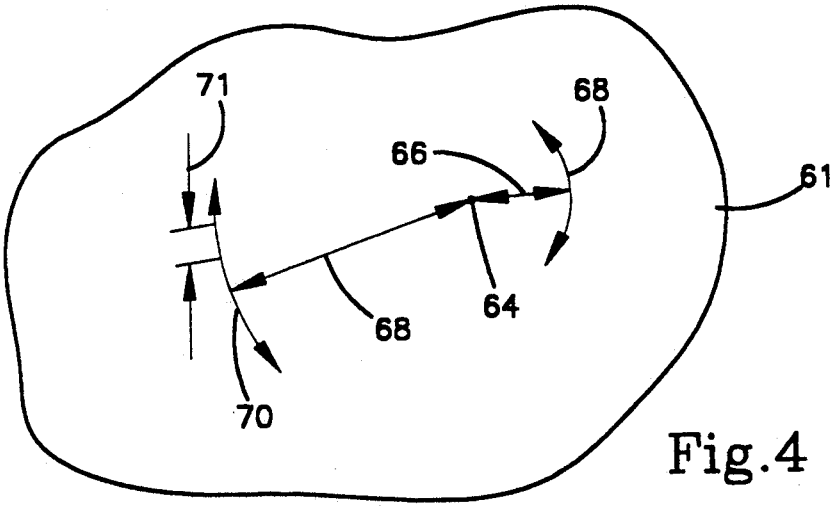
FIG. 4 is a top view of the surface 61 of FIG. 3, illustrating the geometries of multiple nozzle fluid jet cleaners acting on the surface.

FIGS. 3 and 4 illustrate an alternate embodiment of fluid jet cleaner 50 which has a nozzle body 52 which may be rotatable about an axis 54. There is at least one nozzle means 56 positioned within the nozzle body to expel fluid along a centerline 57. This approximates the orientation of projection of a fluid stream from the nozzle means 56, as previously described.

To control the cleaning intensity of the fluid jet cleaner 50, the pressure of fluid within a reservoir 58 formed in the nozzle body 52 is altered, the angle 60 at which the fluid, and the centerline impinges upon a surface 61 to be cleaned is changed, the length 64 which separates the surface 61 from the nozzle means 56 along the axis 54 is modified, the number of nozzle means 56 acting on the surface is altered, or the dimensioning of a nozzle orifice or aperture 59 is changed. Many of the above controls of the cleaning intensity are cross related.

A distance 66 is measured along the surface 61 from where the axis 54 intersects the surface, to where the centerline 57 intersects the surface. This distance 66 will generate a radius 68 of a cleaning circle 70 when the nozzle body 52 is rotated about the axis 54. The smaller the radius 68 (assuming the nozzle body is rotating at a constant speed and all other conditions are identical) the more time the fluid is acting on a constant length 71 of the cleaning circle 70, and the more intense the cleaning action of a fluid jet will be.

The angle 60 at which the centerline 57 (or fluid stream) intersects the surface will also effect the cleaning intensity since the greater the angle 60 (all other conditions being identical), the greater the energy intensity of the fluid jet imparted upon the surface 61 will be.

To alter the angle 60 of the centerline relative to the axis 54 and maintain a constant cleaning circle 70, a nozzle distance 72 (which is the length along the nozzle body, normal to the axis, from the axis to the nozzle means 56) must be altered. For this reason, multiple nozzles 56 may be provided with different nozzle distances 72.

Figure 5:
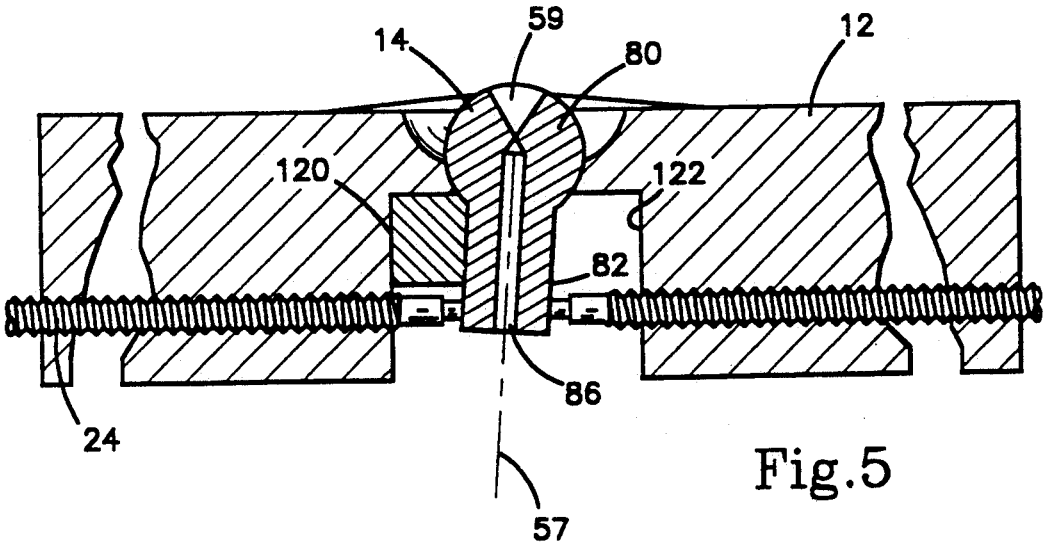
FIG. 5 is a side cross section view of a fluid jet cleaner of the instant invention illustrating the adjustment portion to orient the nozzle means.

The adjustment means used in the instant invention may be any device, which is well known in the art, which adjusts the nozzle stream relative similar to that described in U.S. Pat. No. 4,836,455, (incorporated herein by reference) which discloses using adjustment means for fluid jet systems. The adjustment structure is illustrated in FIG. 5, in which the nozzle or nozzle means 14 includes a body section 80 and a stem portion 82. The nozzle 14 contains a center bore 86 whose orientation determines, for all practical purposes, the orientation of the centerline 57.

To adjust the relative position between the centerline 57 of a nozzle and the nozzle body 12, the radially disposed extensible members 24, extending transversely to the axis 54, are retracted. The stem portion is then aligned as desired, then the extensible members 24 are then extended to lock the nozzle into position.

The transversely extensible rod members 24 are typically set screws. However, they may be any well known device which extends to lock the nozzle means 14 in a desired direction by acting on a side of stem portion 82. Any number of members 24 may be used, even though two to four, substantially evenly spaced in the same plane, have been found optimal. Two transversely extensible members 24 are disposed on opposite sides of the stem portion 82, an the rod members fan exposed out radially from the axis of rotation (see FIG. 4).

Fluid jets may be aimed in two ways. Initially, the operator may "eyeball" the angle 60 of the centerline by observation. Alternately, as illustrated in FIG. 5, a shim 120 may be inserted into a nozzle stem recess 122 which the nozzle stem projects into. Actuation of the stem portion 82 by the adjustment means, to force the stem portion 82 into contact with the shim 120, results in precise and reproducible alignment of the stem portion 82 and thereby precise alignment of the centerline 57.

Figure 6:
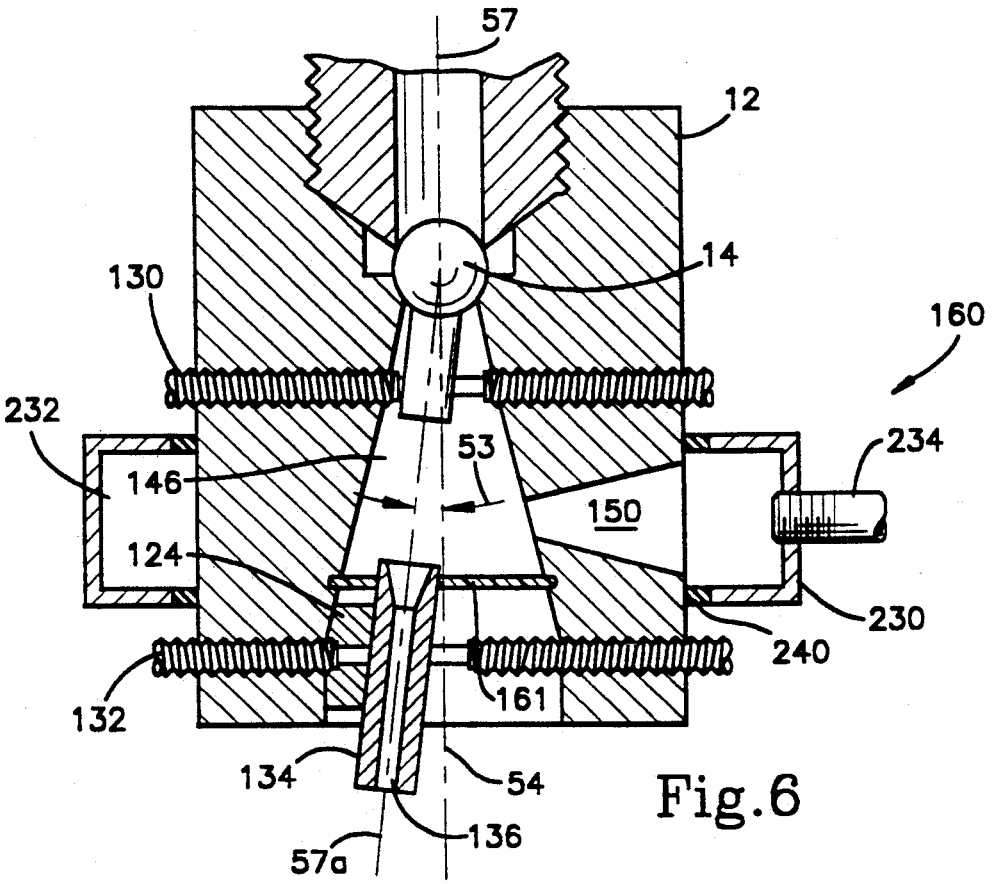
FIG. 6 is a side cross sectional view of a fluid jet cleaner of the present invention, further including an adjustable portion to adjust a section which introduces abrasives to a fluid stream.

FIGS. 6, 7 and 8 illustrate the application of the adjustability feature to abrasive cleaners. In FIG. 6, a first set of adjustment means 130 angularly position the adjustable nozzle 14. A second adjustment means 132, which may be similar to the adjustment means on the above mentioned U.S. Pat. No. 4,836,455 (as is well known in the art) is applied to a focusing tube 134 to align a base 136 having a center line **57*a* of the focusing tube 134 with the centerline 57** of the nozzle.

In aligning the nozzle 14 and the focusing tube 134 of the FIG. 6 embodiment, initially the centerline 57 of the nozzle 14 is set to a desired angle 53 relative to the axis 54 of the nozzle body 12 utilizing the first set of adjustment means 130 in the manner described above. The focusing tube 134 is then positioned relative to the centerline 57 in the following manner. Initially, the second adjustment means 132 (which may comprise a plurality of set screws) are loosened to permit lateral displacement of the focusing tube 134 wherein the center line **57*a* of the bore 136 is aligned (made coaxial) with the centerline 57 of the nozzle 14. Then the second adjustment mean 132** is selectively tightened to hold the focusing tube in that position.

This alignment may be done either manually or by using a tool (not shown) to securely hold the nozzle 14 into the correct position. An example of this type of tool would be one which is elongated and which could partially extend into the bore 136 and moved to control the angular position of the bore 136 relative to the axis 54. The tool includes a portion which extends into the base 136 to precisely position the tool relative to the focusing tube 134, while the user may grasp and manipulate a portion of the tool which is extending from the bore. As soon as the center line **57*a* of the bore bore 136 is aligned with the centerline 57, then all of the second adjustment means 132 are tightened sufficiently to secure the focusing tube 134 into the desired position and angle relative to the nozzle body 12. A shim 124 (which performs similarly to the shim 120 located between the nozzle body 12 and the nozzle stem 14 in the FIG. 5 embodiment) may be applied between the focusing tube 134 and the nozzle body 12 to precisely position the focusing tube 134 within the nozzle body 12**.

FIG. 7 illustrates an alternate embodiment for focusing an abrasive fluid jet cleaner. A unitary abrasive nozzle structure 140 includes an adjustable nozzle 142 and a focusing tube 144. The entire unitary abrasive nozzle structure 140 may be adjusted, by adjustment means 152, as described above. The unitary abrasive structure 140 has a chamber 146 formed therein which receives fluid from the nozzle 142. The chamber 146 communicates, through an aperture 148, to a well known abrasive injection device 160 including an aperture 150 as illustrated in FIGS. 6 and 7 and described below. A seal 161 limits passage of fluid and abrasives from the abrasive injection device 160 about the outer periphery of the focusing tube 134 to the atmosphere.

FIG. 8 illustrates a final alternate embodiment capable of adjusting a focusing tube 200 and a nozzle 202 (having a centerline 203) for a fluid jet cleaner. A nozzle body 204 has an axis 206 which the adjustment means may be focused (by a first adjustment means 207) thereabout. The nozzle body 204 has a substantially semi-circular mounting portion 208 surrounding a nozzle recess 210 which the nozzle 202 is mounted within. A focusing mount 212 includes a socket portion 214 which matingly engages with the semi-circular mounting portion 208. A cylindrical focusing recess 216 is formed in the focusing mount 212 which the focusing tube 200 is mounted within. The focusing tube 200 has an opening 218 formed therein Second adjustment means 220, which consist of a plurality of set screws, position the focusing mount 212 relative to the nozzle body. The adjustment of the second adjustment means 220 regulates the position of the opening relative to the centerline 203, but the FIG. 8 configuration ensures that the opening is continually directed towards the nozzle 202. To set the position of the FIG. 8 embodiment, the centerline 203 is set by adjusting the first adjusting means 208. The focusing mount 212 is then adjusted (by adjusting the second adjusting means 220) until the center line **54*a* of bore 218 is aligned with the centerline 203. The angular position of the bore 218 is automatically directed toward the centerline. Abrasives are inserted by an abrasive injection device 221 as shown in FIG. 8 and described below. Lower seals 222 and upper seals 224 are mounted on the focusing mount to limit fluid and abrasive passage from the abrasive injection device 221 (about the external circumference of the focusing tube 200 and the nozzle body 204, respectively) to the atmosphere. The seals 222 and 224 also maintain a vacuum in a chamber 146 as caused by the normal operation of the fluid jet directed along the centerline 57. These functions are also covered by seals 161 in the FIGS. 6 and 7** embodiments.

The abrasive injection device (160 in FIGS. 6 and 7, and 221 in FIG. 8) operate in the following manner. A stationary annular collar 23 is circumferentially mounted about the nozzle body 12 in FIGS. 6 and 7 (or the focusing mount 212 in FIG. 8). An annular recess 232 is defined within the annular collar 230. An injection tube 234 is in fluid communication with the annular recess 232, and provides passage for a fluid consisting primarily of abrasives and entrained air to be combined with the fluid jet in a manner well known in the art. Rotary circumferential seals 240 limit passage of the fluid from between the annular collar 230 and the nozzle body in FIGS. 6 and 7, or the focusing mount 212 in FIG. 8.

The stationary annular collar 230 configuration in FIGS. 6, 7 and 8 permit rotation of the nozzle body 12 (in FIGS. 6 and 7), or the focusing tube (FIG. 8) about an axis 54 while maintaining a substantially constant application of the fluid from the injection tube 234, via the aperture 150, to the chamber 146.

It is to be understood that the above describes the preferred embodiments, and are not intended as limitations to the inventive scope of the present disclosure, as set forth in the claims.

Having described the invention, what is claimed is:

1. A fluid jet system comprising:

a nozzle body having an axis;

nozzle means adjustably mounted within the nozzle body for dispersing fluid along a first centerline, the first centerline having an adjustable angle with respect to the axis;

first adjustment means for adjusting the orientation of the nozzle means relative to the nozzle body;

a focusing tube adjustably mounted within the nozzle body and having a second centerline, the second centerline having an adjustable angle with respect to the axis; and second adjustment means for adjusting the orientation of the second centerline of the focusing tube relative to the nozzle body, and into alignment with the nozzle means, so that said first and second centerlines may be aligned and wherein said first and second adjustment means are independent of one another.

2. The fluid jet system as described in claim 1, wherein the focusing tube includes an opening therethrough for focusing the fluid dispersed from the nozzle means.

3. The fluid jet system as described in claim ,1 wherein the second adjustment means comprises:

a transversely extending rod member, positioned to contact the focusing tube to limit motion of the focusing tube towards the rod member.

4. The fluid jet system as described in claim 1, wherein the first adjustment means comprises:

a transversely extending rod member, positioned to contact the nozzle means to limit motion of the nozzle means towards the rod member.

5. The fluid jet apparatus as described in claim 1, further comprising:

a shim disposed between the nozzle body and the focusing tube.

6. The fluid jet apparatus as described in claim 1, wherein the nozzle means include a nozzle stem and further comprising:

shim means, disposed between the nozzle body and the nozzle stem, for precisely positioning the nozzle stem relative to the nozzle body.

7. The apparatus as described in claim 1, wherein the nozzle body is rotatable about said axis.

8. A fluid jet system comprising:

a nozzle body adapted for continuous rotation about an axis when in operation;

a stationary abrasive material insertion collar circumferentially mounted about said nozzle body for inserting abrasive material into the nozzle body;

nozzle means adjustably mounted within the nozzle body for dispersing fluid along a first centerline, the first centerline having an adjustable angle with respect to the axis;

a focusing tube adjustably mounted within the nozzle body and having a second centerline, the second centerline having an adjustable angle with respect to the axis; and adjustment means for adjusting the orientation of the second focusing tube with centerline of the nozzle means first centerline of the independent of one another.

* * * * *